US008166574B2

(12) United States Patent
Hassler

(10) Patent No.: US 8,166,574 B2
(45) Date of Patent: May 1, 2012

(54) PROTECTIVE HELMET

(75) Inventor: Andreas Hassler, Rohrdorf (DE)

(73) Assignee: OPED AG, Steinhausen (CH)

( * ) Notice: Subject to any disclaimer, the term of this patent is extended or adjusted under 35 U.S.C. 154(b) by 201 days.

(21) Appl. No.: 12/514,282

(22) PCT Filed: Oct. 26, 2007

(86) PCT No.: PCT/EP2007/009311

§ 371 (c)(1),
(2), (4) Date: May 8, 2009

(87) PCT Pub. No.: WO2008/055598

PCT Pub. Date: May 15, 2008

(65) Prior Publication Data

US 2009/0320185 A1 Dec. 31, 2009

(30) Foreign Application Priority Data

Nov. 10, 2006 (DE) ..... 10 2006 053 369

(51) Int. Cl.
*A42B 3/12* (2006.01)

(52) U.S. Cl. ..... 2/413; 2/414

(58) Field of Classification Search ..... 2/411, 413, 2/412, 414, 425

See application file for complete search history.

(56) References Cited

U.S. PATENT DOCUMENTS 3,872,511 A * 3/1975 Nichols ..... 2/413
4,343,047 A 8/1982 Lazowski et al.
4,345,338 A * 8/1982 Frieder et al. ..... 2/414
5,181,279 A * 1/1993 Ross ..... 2/413
5,309,576 A * 5/1994 Broersma ..... 2/412
5,556,169 A 9/1996 Parrish et al.
5,815,846 A 10/1998 Calonge
5,913,412 A * 6/1999 Huber et al. ..... 2/414
5,950,244 A * 9/1999 Fournier et al. ..... 2/414
5,956,777 A * 9/1999 Popovich ..... 2/424
6,351,854 B1 3/2002 Whalen et al.
7,089,602 B2 * 8/2006 Talluri ..... 2/411
7,254,843 B2 * 8/2007 Talluri ..... 2/411

(Continued)

FOREIGN PATENT DOCUMENTS

DE 4409839 A1 9/1995

(Continued)

OTHER PUBLICATIONS

Office Action from Chinese Patent Office, dated Jun. 12, 2010, 6 pages.

(Continued)

*Primary Examiner* — Danny Worrell
(74) *Attorney, Agent, or Firm* — Fredrikson & Byron, PA

(57) ABSTRACT

The invention relates to a protective helmet (10), particularly for motorcyclists or the like, having an exterior casing particularly configured as an exterior shell (11), and a lining element arrangement (12), which is received in the exterior casing and lines the same at least in some regions, wherein the lining element arrangement (12) has at least two lining elements, wherein at least one lining element is configured as a cushion element (14) filled with filling bodies (21), and at least one further lining element is configured as a lining shell element (17), wherein the cushion element (14) is surrounded at least along its contour by at least one lining shell element (17), which at least partially supports a contour surface of the cushion element (14).

10 Claims, 5 Drawing Sheets

U.S. PATENT DOCUMENTS

| | | | | |
|---|---|---|---|---|
| 7,673,351 | B2 * | 3/2010 | Copeland et al. | 2/425 |
| 2007/0000032 | A1 * | 1/2007 | Morgan | 2/412 |

FOREIGN PATENT DOCUMENTS

| | | | |
|---|---|---|---|
| DE | 69634862 | T2 | 5/2006 |
| EP | 1066765 | B1 | 6/2005 |
| GB | 947772 | A | 1/1964 |
| JP | 03137207 | | 6/1991 |
| JP | 10501585 | | 2/1998 |
| JP | 11256417 | | 9/1999 |
| JP | 11286822 | | 10/1999 |

OTHER PUBLICATIONS

"PCT International Search Report dated Feb. 27, 2008, from which the instant application is based," 2 pgs.

English Translation of First Office Action, Pat. App. No. 2009-535602, Dec. 5, 2011, 3 pages.

English Abstract, Japanese Publication No. 03-137207, Nov. 6, 1991, 1 page.

English Translation of Japanese Publication No. 11-286822, Oct. 19, 1999, 17 pages.

English Translation of Japanese Publication No. 11-256417, Sep. 21, 1999, 18 pages.

* cited by examiner

PROTECTIVE HELMET

RELATED APPLICATIONS

This application is a 35 U.S.C. 371 national stage filing from International Application No. PCT/EP2007/009311 filed Oct. 26, 2007, which claims priority to German Patent Application No. 10 2006 053 369.0, filed Nov. 10, 2006, the teachings of which are incorporated herein by reference.

The invention relates to a protective helmet, particularly for motorcyclists or the like, having an exterior casing configured as an exterior shell, and a lining element arrangement, which is received in the exterior casing and lines the same in at least some regions, wherein the lining element arrangement has at least two lining elements.

Protective helmets of the aforementioned type normally have a hard exterior shell, a relatively soft, shock-absorbing interior shell, and a resilient padding. The exterior shell assumes here the function of a protective casing of the interior shell formed as the lining. Through the exterior shell, collision shocks are transmitted into the lining and are substantially absorbed by means of an irreversible deformation of the lining. Typically, lining elements of a protective helmet hence consist of a foamed plastic such as, for example, polystyrene. To achieve a protective effect which is as good as possible, it is particularly important that the interior lining surrounds the head of the helmet user in a preferably tight-fitting manner. Since in industrial series, only certain standard sizes of linings can be manufactured cost-efficiently and, on the other hand, different skull geometries exist, the optimal fit of a protective helmet is hard to realize. When customizing a new protective helmet there is hence the problem to realize a tight but still comfortable fit of the helmet on the head of the helmet user. An irregular fit of the protective helmet results frequently in the fact that unpleasant pressure marks are felt when wearing the helmet for a longer period, which can result in head aches for the helmet user.

From the prior art, protective helmets are known which have an interior helmet lining that is adaptable to the individual head shape by means of the use of deformable linings such as, for example, air cushions and gel cushions. Since liquids are incompressible to a large extent, and gases, on the other hand, have a high compressibility, such interior helmet linings are particularly disadvantageous with respect to shock absorption. Further, the displacement effect and the internal pressure of flexible and gas-filled lining elements are difficult to control. Potential leaks and pressure losses can reduce the protective effect of such a helmet.

From DE 44 09 839 C2, a protective helmet is known which has a lining consisting of cushion segments filled with elastic filling bodies. The cushion segments adapt to the head shape when placing the protective helmet on the head, and are evacuated upon the correct fit of the protective helmet by means of a vacuum pump. Thereby, the elastic filling bodies of the cushion segments are fixed to a large extent in their position, whereby a dimensionally stable interior helmet lining is obtained which is adapted to the head shape.

To achieve a satisfying user comfort of the protective helmet, the cushion segments must be manually evacuated on the backside of the helmet by means of a vacuum pump after placing the helmet on the head, and before taking-off the helmet, air has to be fed again to the cushion segments.

The present invention is hence based on the object to propose a protective helmet which ensures a firm, tight fit of the protective helmet, considers individual adaptation options, avoids unhealthful pressure marks on the head of the user, and, at the same time, has good shock-absorbing characteristics as well as a simple structure and is hence cost-efficient with respect to manufacturing.

This object is achieved by means of a protective helmet with the features of claim 1.

The protective helmet comprises an exterior casing configured as an exterior shell and a lining arrangement, which is received in the exterior casing and lines the same at least in some regions, wherein the lining element arrangement has at least two lining elements. At least one of the lining elements is configured as a cushion element filled with filling bodies, which said cushion element adapts in an advantageous manner to the head shape, thereby helping to avoid pressure marks. The cushion element can be filled with substantially spherical filling bodies. The characteristics of the cushion element with respect to damping and shock absorption can be influenced in an advantageous manner by means of filling bodies with elastic characteristics, the size of the filling bodies, the simultaneous use of differently sized filling bodies, the addition of fibers, and the thickness of the cushion element itself. At least one further lining element is configured as a lining shell element. It has been proven to be particularly advantageous when the lining shell element consists of a dimensionally stable, foamed plastic with very good shock-absorbing characteristics. To prevent a lateral shifting movement of the cushion element during a collision shock, the cushion element is surrounded at least along its contour or along its outer edge surface, respectively, by at least one lining shell element. The lining shell element encloses, and thus, supports the outer contour or edge surface, respectively, of the cushion element so that it cannot expand sideways and is kept in a dimensionally stable position, even during a collision shock. This allows a substantially full shock absorption by means of the filling bodies of the cushion element.

The protective helmet according to the invention can have a plurality of cushion elements which, at least in the region of the forehead, the temples, and the back of the head of the helmet user, are arranged opposite to each other. This arrangement is of particular advantage since, by means of a tight contact of the helmet with the aforementioned areas of the head, a particularly good fit of the helmet can be achieved. By means of deformable cushion elements and the uniform fit of the same on the head of the helmet user, the aforementioned areas of the head can be protected against unhealthful pressure peaks. Thereby, a tight but still comfortable fit of the helmet can be realized with good shock-absorbing characteristics on the important contact areas of the head.

In a particularly preferred embodiment, the lining shell element can be formed from a plurality of lining shell segments. By using a plurality of lining shell segments, the assembly of the lining elements within the exterior shell of the helmet is significantly simplified. Hence, a cushion element can be enclosed by a plurality of lining shell segments. By means of an advantageous shaping of the lining shell segments, a closed, form-fitting lining element arrangement can be formed within the exterior shell of the helmet. Thereby, if necessary, a fixation of the lining elements within the exterior casing by means of adhesive material can be omitted.

A cushion element received in a lining shell element can project from the lining shell element's surface facing towards the head of the helmet user. This is particularly advantageous when the projecting surface of the cushion element is easily deformable and resilient and hence results in a good adaptation of the cushion element to the head of the helmet user.

To fix the cushion element in its intended position and to secure it against rotating, it is particularly advantageous when the cushion element forms a contour describing a polygonal shape. With the exception of a circular shape, all other contour shapes can be suitable to ensure rotation prevention of the cushion element.

In a particularly preferred embodiment, the cushion element is ventilated by means of a ventilation device in such a manner that upon applying pressure from outside on the cushion element, the air present within the cushion element is pressed outwards. The adaptation of the cushion element to the head of the helmet user can be facilitated in that between the filling bodies within the cushion element, an intermediate air space exists, which ensures a good movability of the filling bodies. By a reduction of the intermediate air space between the filling bodies by means of a ventilation device when placing the protective helmet on the head, the filling bodies are brought into a dimensionally stable position by mutual contact. Thus, a dimensionally stable adaptation of the cushion element to the head surface can be ensured.

An advantageous variant of the ventilation device consists in configuring the ventilation device as an air-porous cushion element wall. Further, the ventilation device can be configured as a ventilation duct system, wherein by means of a connection of the cushion elements via the ventilation duct system, also the sequence of the ventilation of the cushion elements can be controlled. Thus, in particular during placement the helmet on the head, a simultaneous, relatively uniform adaptation of the cushion elements to the head surface can be ensured. In a further advantageous embodiment, the ventilation duct system can have a check valve which is preferably formed on the exterior casing and which prevents the backflow of air pushed out of the cushion elements. Thus, the shape of the cushion elements adapted to the head shape can be fixed in a long-lasting manner. Further, potential reset forces of the filling bodies affecting the head surface can also be blocked.

It is proven to be particularly advantageous when at least one further lining element is configured as a padding element which is arranged between the head of the helmet user and further lining elements which are received within the exterior casing. The padding element can have different cover layers or functional layers, respectively, which ensure a bonding of the padding element, a humidity transport, ventilation, and pleasant wearing comfort. The padding element can provide for a continuous transition between the rest of the lining elements and, for this purpose, can be formed in different thicknesses, and, as a whole, can consist of a plurality of individual padding elements.

Further embodiments of the protective helmet according to the invention can be configured with differently formed, replaceable cushion and padding elements for the individual adaptation to the respective head shape. A cushion element can also be received by a lining element in such a manner that all surfaces of the cushion element, except for the surface which is facing towards the head of the helmet user, are surrounded by the lining shell element. Here, it is proven to be particularly advantageous that the lining shell element is formed between the cushion element and an exterior shell of the helmet. Thus, depending on the thickness of the lining shell element in the region of the cushion element, the cushion element can be received in different thicknesses within the lining shell element.

In the following, the invention is explained in more detail with reference to the attached drawing.

Figure 1:
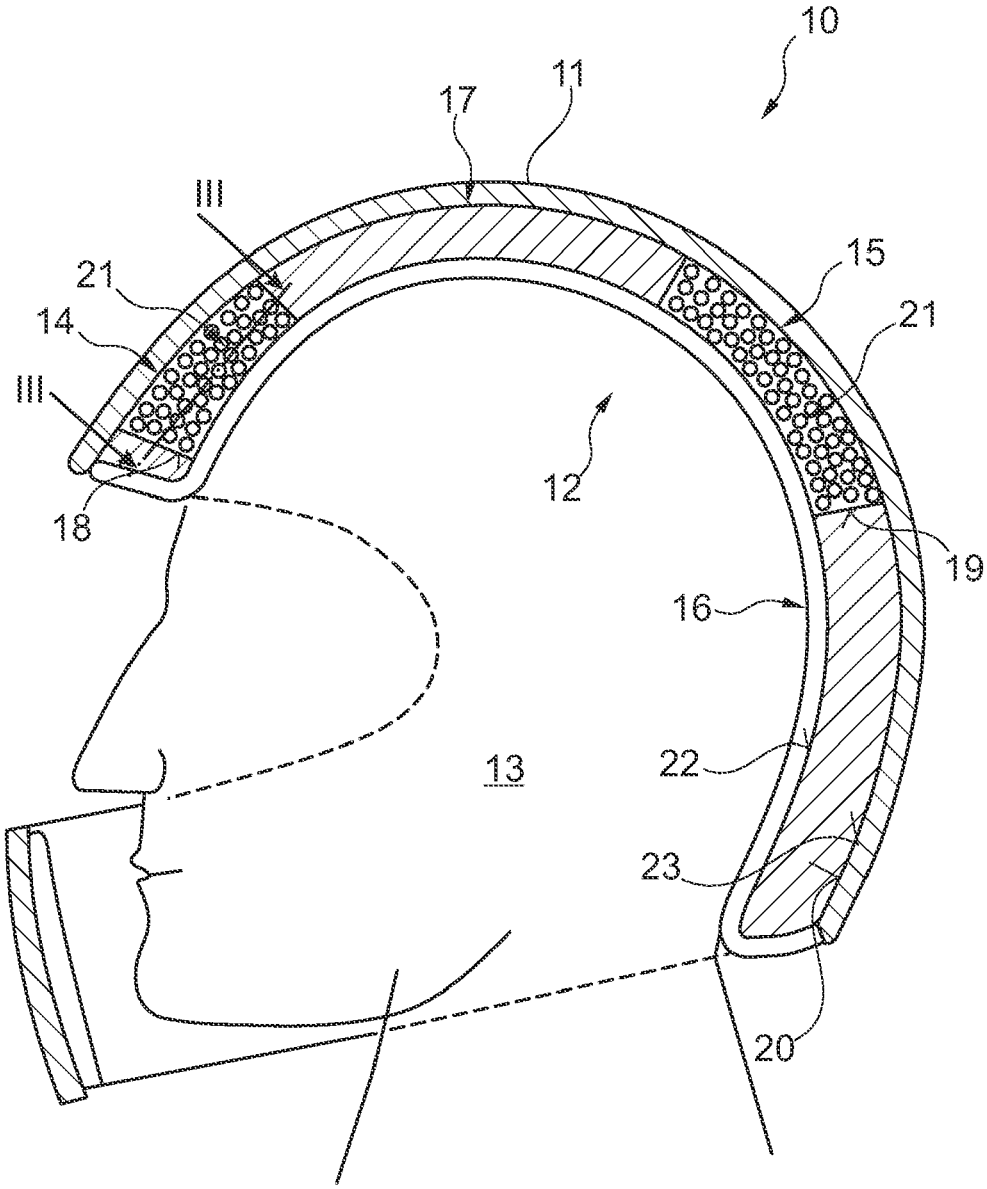
FIG. 1 shows a protective helmet with the exterior shell illustrated in a sectional view and with the lining element arrangement illustrated in a sectional view.

FIG. 1 shows a protective helmet 10 which, for a better illustration, is shown in a sectional view with its exterior casing configured as an exterior shell 11 and with a lining element arrangement 12 received therein. The protective helmet 10 which is shown here placed on the head 13 of a helmet user concerns a full-face helmet for a motorcyclist. This helmet could also be designed as a jet helmet or as a half-face helmet. In addition, in particular with respect to the configuration of the exterior shell 11, lighter embodiments are conceivable, which are used, for example, for different winter sports or by bicyclists.

Irrespective of the design of the exterior shell 11, in any case, a lining element arrangement 12 is provided which, in this exemplary embodiment, is composed of cushion elements 14 and 15, as well as a padding element 16, and a lining shell element 17 surrounding the cushion elements. The lining shell element 17 covers here substantially an interior surface 20 of the exterior shell 11, except for the areas which are covered by the cushion elements 14 and 15. The cushion elements 14 and 15 are surrounded along their contour surface 18 or 19, respectively, by the lining shell element 17 and are supported along this surface by the lining shell element 17. Further cushion elements, which are not shown in more detail here, are arranged in the temple areas of the head 13. The individual cushion elements 14 and 15 are filled with a plurality of elastic filling bodies 21, wherein the filling bodies, due to air inside the cushion element, are moveable with respect to each other. Thereby, a limited resilient and barely elastic surface of the cushion elements 14 and 15 is created, which surface is facing towards the head 13.

To ensure pleasant wearing comfort of the protective helmet 10, the lining element arrangement 12 has a padding element 16 on its side facing towards the head 13, which padding element, in this exemplary embodiment, consists of functional material layers, which are not shown in more detail here, and is connected, by means of a glue layer configured as an adhesive layer 22, with other lining elements of the lining element arrangement 12. A further glue layer configured as an adhesive layer 23 on the interior surface 20 of the exterior shell 11 connects the lining shell element 17 and the cushion elements 14 and 15 with the exterior shell 11.

Irrespective of the illustration shown in this exemplary embodiment, the lining shell element 17 can consist of a plurality of lining shell segments and can be firmly received within the exterior shell 11 in a form-fitting manner or by means of a detachable, force-locked connection.

Figure 2:
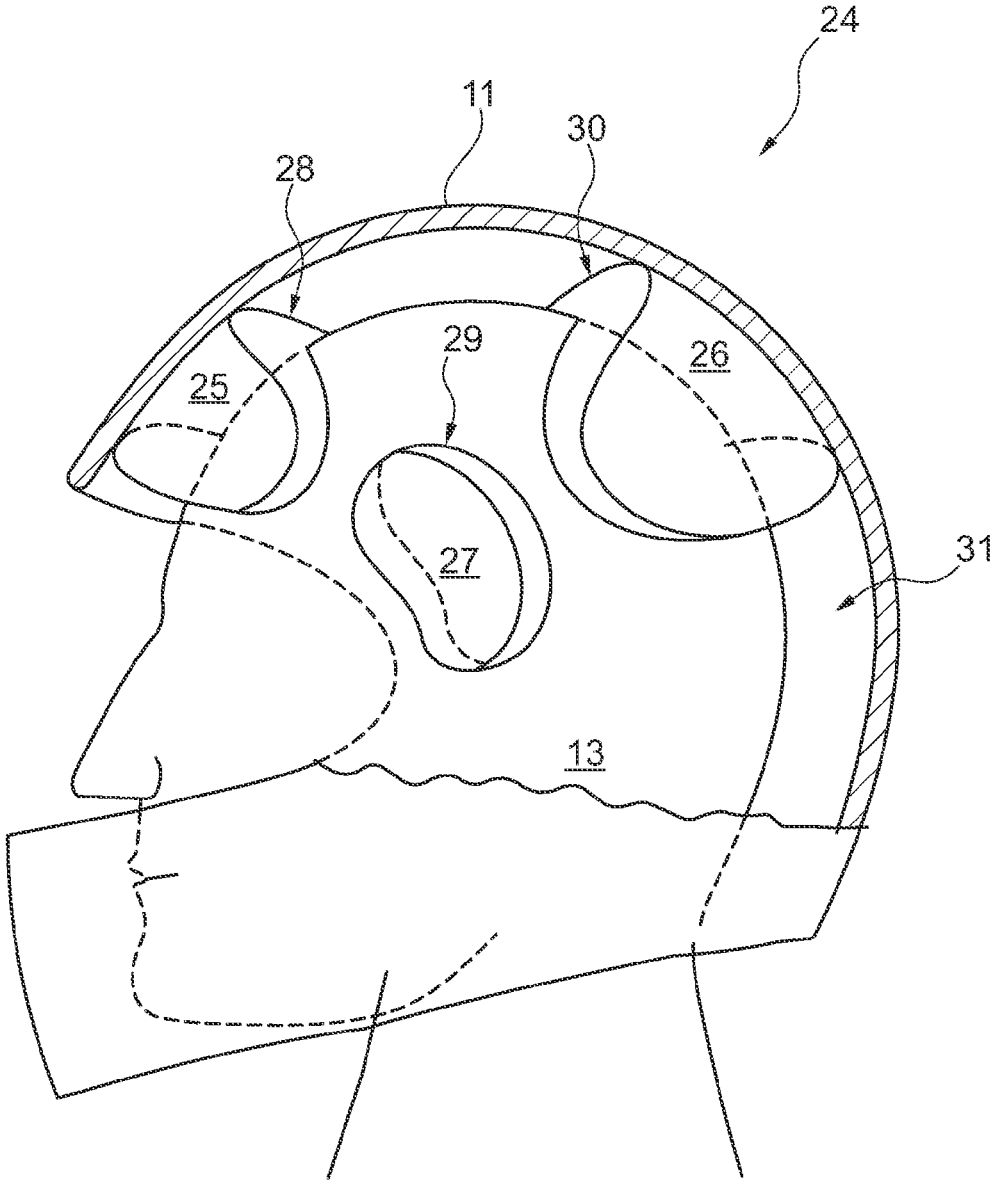
FIG. 2 shows a protective helmet with the exterior shell illustrated in a sectional view and with cushion elements received therein.

FIG. 2 shows a protective helmet 24 in a partial sectional view of the exterior shell 11 and with completely formed cushion elements 25, 26, and 27. Here, the cushion element 25 is arranged in the area of the forehead, the cushion element 26 is arranged in the area of the back of the head, and the cushion element 27 is arranged in the area of the temple of the head 13. A further cushion element is arranged on the side (not shown) of the head 13 opposing the cushion element 27. Here, within their contour 28, 29, 30, the cushion elements 25, 26, 27 substantially cover the aforementioned areas of the head 13 with the surface facing towards the head 13. Due to their flexible material characteristics, the cushion elements 25, 26, 27 adapt to a lining space 31 formed between the exterior shell 11 and the head 13. The contour 28, 29, 30 describes here different free-forms which correspond thereto. Further, corresponding to the distance between the exterior shell 11 and the head 13, the thickness of the cushion elements 25, 26, 27 can vary.

Figure 3:
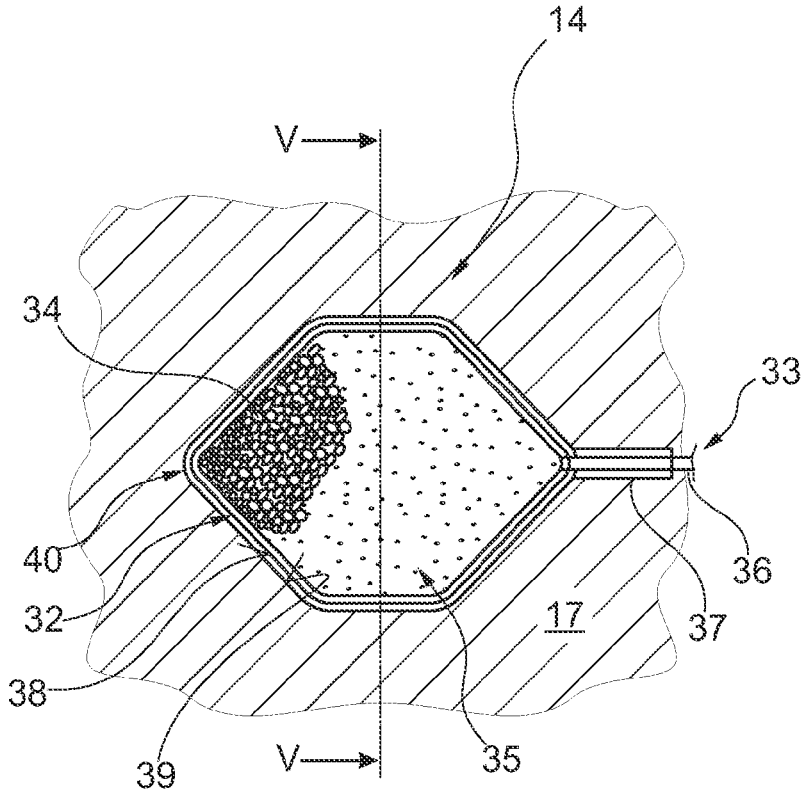
FIG. 3 shows a cushion element in a sectional view along a line III-III in FIG. 1, according to a first embodiment.

The cushion element 14 shown in FIG. 1 is illustrated in FIG. 3 in a sectional view along a line III-III of FIG. 1. The cushion element 14 consists of a cushion element wall 32 which forms the outer casing of the cushion element 14, a ventilation device 33, and elastic filling bodies 34 which completely fill an interior 35 of the cushion element 14. In this exemplary embodiment, the cushion element wall 32 is connected with a hose 36 which represents a part of the ventilation device 33, wherein the hose 36 is integrated in a recess 37 within the lining shell element 17. In its further route, the hose 36 is connected to a check valve which is not shown in this illustration. Overall, the cushion element 14 is surrounded by the lining element 17 along a contour surface 38, wherein the contour surface 38 is arranged adjacent to a support surface 39 or abuts against it, respectively, and the support surface 39 is formed by a recess 40 within the lining shell element 17. When, as a result of a collision shock, a surface pressure is applied perpendicular to the drawing plane onto the cushion element 14, a displacement of the air within the interior 35 through the hose 36, and a densification of the filling bodies 34 as well as an application of supporting forces via the contour surface 38 onto the supporting surface 39 of the lining shell element 17 or the interior surface 20 of the exterior shell 11, respectively, as shown in FIG. 1, take place. Thus, the cushion element 14 as a whole is kept in a substantially dimensionally stable position, whereby its shock-absorbing material characteristics can be fully utilized.

Figure 4:
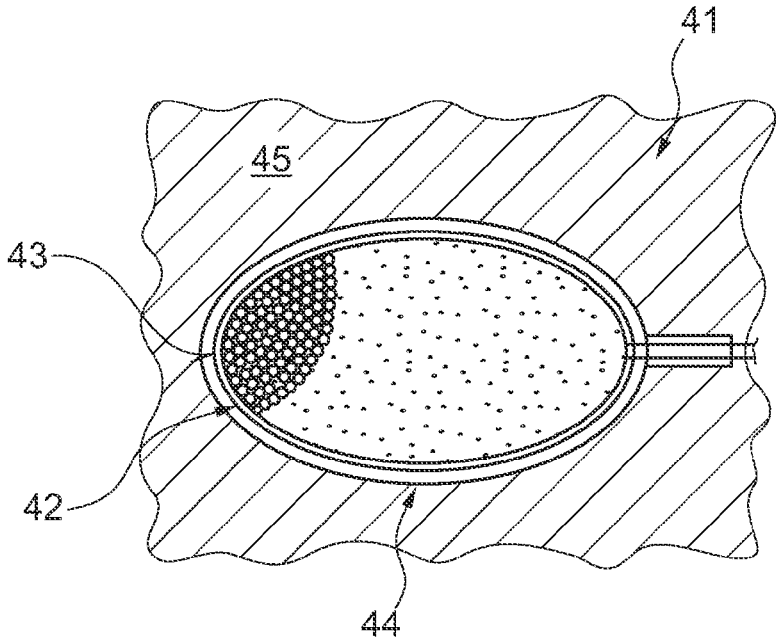
FIG. 4 shows the same sectional view of a cushion element according to a second embodiment.

A further embodiment of a cushion element 41 is shown in FIG. 4. Here, a cushion element wall 42 is formed in a free-form corresponding to a contour surface 43 so that the cushion element 41 cannot rotate within a recess 44 of a lining shell element 45. Further, due to the free-form, a surface-optimized adaptation to an area of a head (not shown here) is possible.

Figure 5:
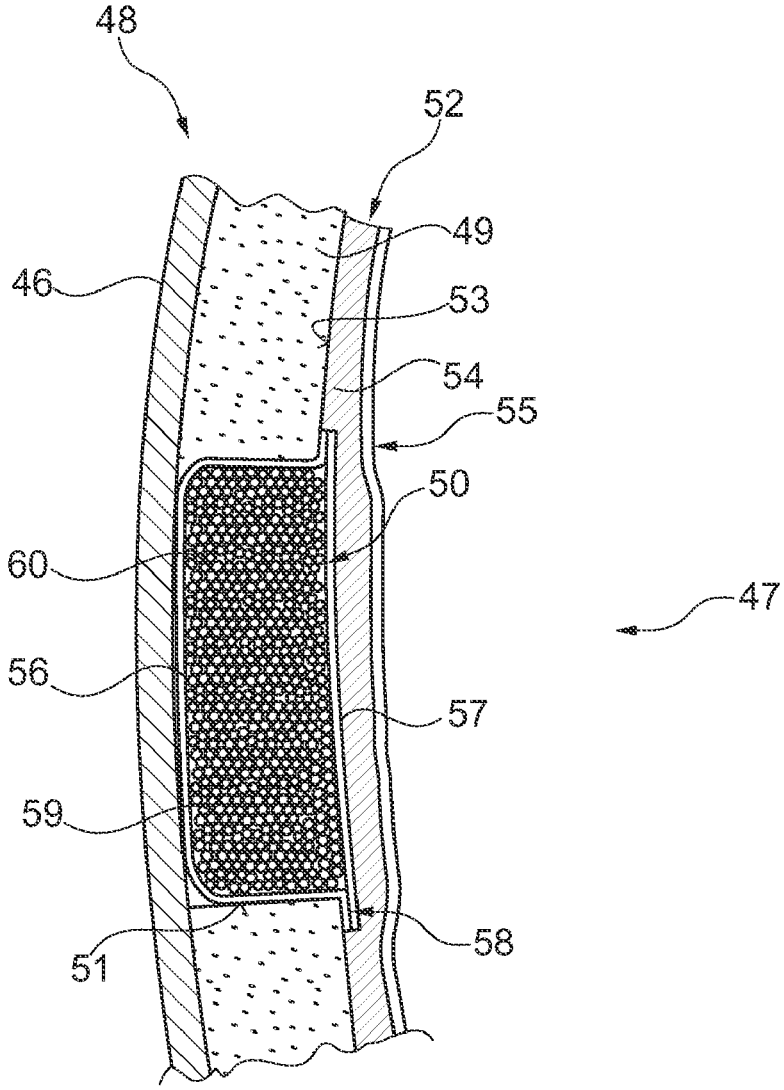
FIG. 5 shows an exterior shell with a lining element arrangement in a sectional view along a line V-V in FIG. 3.

FIG. 5 shows an exterior shell 46 in a sectional view and a lining element arrangement 47 of a protective helmet 48 in a sectional view along a section line V-V in FIG. 3. The lining element arrangement 47 consists of a lining shell element 49, which encloses a cushion element 50 along a contour surface 51, and a padding element 52, which covers the cushion element 50 and the lining shell element 49 on the side facing towards the head (not shown here) substantially over the whole surface. The padding element 52, in turn, has different functional material layers such as a glue connection configured as an adhesive layer 53, a padding 54 configured as a ventilation- and humidity-controlling layer, and a fleece layer 55 which increases the wearing comfort and which is in direct contact with the head surface. The padding element 52 compensates here for potential height differences between the surfaces of the cushion element 50 facing towards the head and the lining shell element 49.

The cushion element 50 has a cushion element wall 56 and a cushion element closing wall 57 which are continuously welded in a contact area 58, and which receive, within an interior 50 surrounded by the cushion element walls 56, 57, a plurality of substantially elastic, round filling bodies 60. The filling bodies 60 fill the whole interior 59 completely, except for the air space between the filling bodies abutting against each other. The cushion element walls 56, 57 are formed by an elastic and pressure-resistant plastic material. Deviating from the filling bodies 60 made of plastic illustrated in this exemplary embodiment, these filling bodies can also consist of other suitable materials, can be influenced by means of admixtures of plastic fibers with respect to their moving characteristics, can consist of filling bodies with different sizes, or can be formed in all different shapes.

Figure 6:
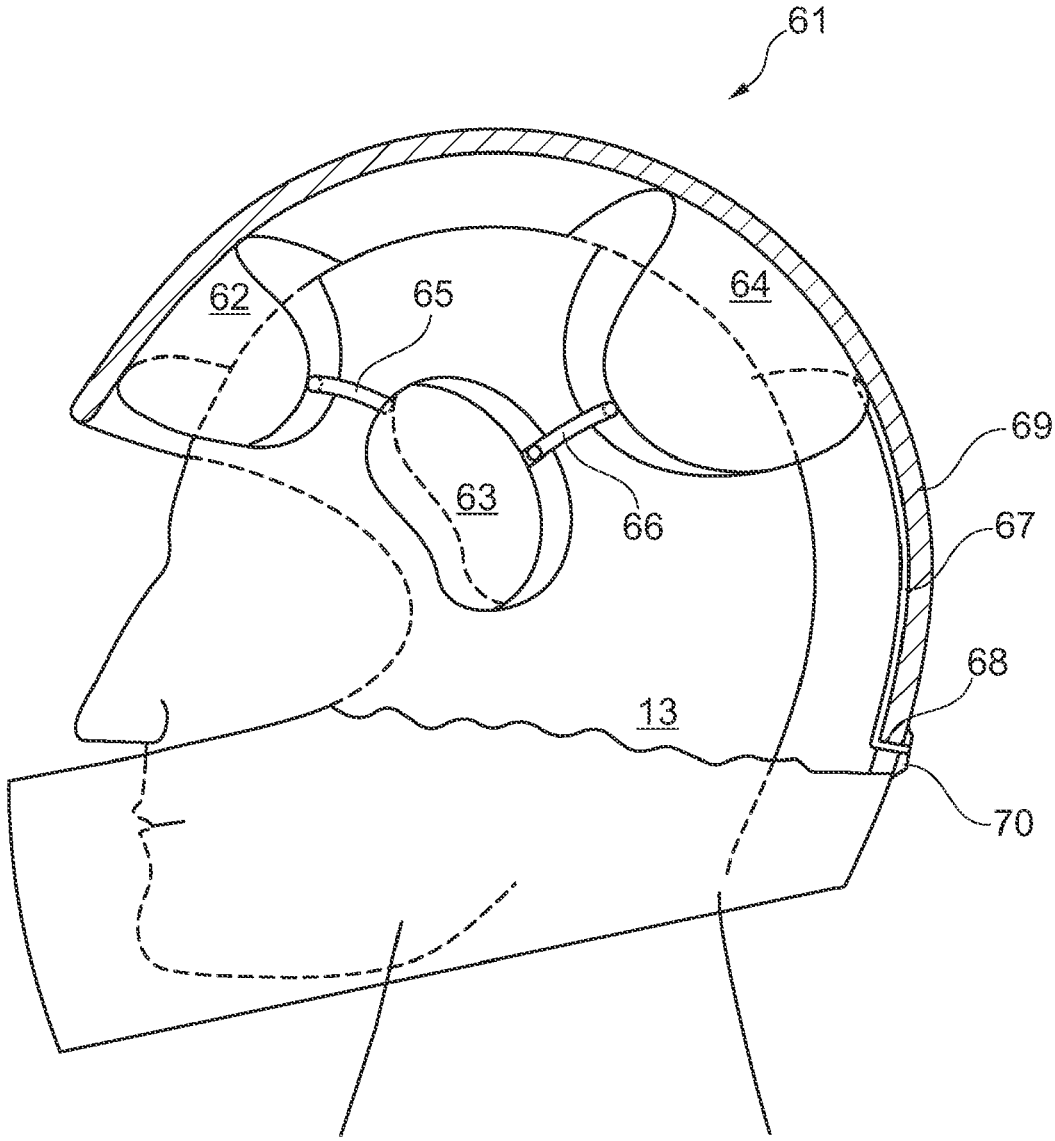
FIG. 6 shows a protective helmet with an exterior shell illustrated in a sectional view and cushion elements with a ventilation device received therein.

FIG. 6 shows a protective helmet 61 according to the illustration of a protective helmet in FIG. 2, wherein cushion elements 62, 63, 64 are interconnected by means of hoses 65 and 66 as part of a ventilation system. Also part of the ventilation system is a hose 67, which runs through a penetration 68 in an exterior shell 69 of the protective helmet 61 towards the outside and is connected there with a check valve 70. During placement of the protective helmet 61 onto the head 13, the check valve 70 has the function to feed the air enclosed inside the cushion elements 62, 63, 64 towards the outside and to prevent the air from re-entering into the cushion elements. The hoses 65, 66, 67 serve here for conveying or discharging the air to the check valve, respectively. Moreover, the check valve 70 has the function, by means of a simple manual handling, to allow outside air to flow through the ventilation system back again into the cushion elements 62, 63, 64. This can be necessary, in particular, when the protective helmet 61 is taken off the head 13 of the helmet user and a re-adaptation or new adaptation, respectively, of the protective helmet 61 to the head of a helmet user is to be carried out.

The invention claimed is:

1. A protective helmet for a helmet user, comprising:

an exterior casing configured as an exterior shell having a plurality of regions, a lining element arrangement, which is received in and lines the exterior casing in at least one or more of the plurality of regions, wherein the lining element arrangement comprises at least two lining elements and at least one lining element is configured as a cushion element having a contour and at least one further lining element is configured as a lining shell element, and wherein the cushion element is filled with elastic filling bodies, is surrounded at least along its contour by at least one lining shell element which partially supports a contour surface of the cushion element, and is in communication with a ventilation device configured as a ventilation device through which air in the cushion element passes outwardly upon application of pressure from the outside.

2. The protective helmet according to claim 1, wherein the lining element arrangement comprises a plurality of cushion elements, which are arranged in a plurality of areas corresponding to a helmet user's forehead, temples and back of the head.

3. The protective helmet according to claim 1, wherein the lining shell element is formed by a plurality of lining shell segments.

4. The protective helmet according to claim 1, wherein the cushion element projects from a surface of the lining shell element, which surface faces towards the head of the helmet user.

5. The protective helmet according to claim 1, wherein the cushion element forms a contour have a polygonal shape.

6. The protective helmet according to claim 1, wherein the ventilation duct system has a check valve.

7. The protective helmet according to claim 6, wherein the check valve is formed on the exterior casing.

8. The protective helmet according to claim 1, wherein at least another lining element is configured as a padding element which is arranged between the head of the user and further lining elements which are received within the exterior casing.

9. A protective helmet for a helmet user, comprising:

an exterior casing configured as an exterior shell having a plurality of regions, a lining element arrangement, which is received in and lines the exterior casing in at least one or more of the plurality of regions, and a ventilation device configured as a ventilation duct system, wherein the lining element arrangement comprises at least two lining elements and at least one lining element is configured as a cushion element having a contour and at least one further lining element is configured as a lining shell element, wherein the cushion element is at least partially filled with elastic filling bodies and is contacted at least along a portion of its contour by at least one lining shell element which partially supports a contour surface of the cushion element, and wherein the cushion element is in communication with the ventilation device.

10. A protective helmet for a helmet user, comprising:

an exterior casing configured as an exterior shell having a plurality of regions, a lining element arrangement, which is received in and lines the exterior casing in at least one or more of the plurality of regions, and a ventilation device configured as a ventilation duct system; wherein the lining element arrangement comprises at least two lining elements and at least one lining element is configured as a cushion element having a contour and at least one further lining element is configured as a lining shell element, and wherein the cushion element is contacted at least along a portion of its contour by at least one lining shell element which partially supports a contour surface of the cushion element and wherein the cushion element is in communication with the ventilation device through which air in the cushion element passes outwardly upon application of pressure from the outside.

* * * * *